US005728072A

United States Patent [19]

Hastings

[11] Patent Number: 5,728,072

[45] Date of Patent: Mar. 17, 1998

[54] DISPOSABLE EARLOBE PIERCING DEVICE AND THE LIKE

[76] Inventor: John A. Hastings, 31 Old Main St., Bass River, Mass. 02664

[21] Appl. No.: 475,037

[22] Filed: Jun. 7, 1995

[51] Int. Cl.[6] ..... A61B 17/00

[52] U.S. Cl. ..... 606/185

[58] Field of Search ..... 606/108, 109, 606/117, 188; 604/59, 60, 61

[56] References Cited

U.S. PATENT DOCUMENTS

| | | | |
|---|---|---|---|
| 3,187,751 | 6/1965 | Coren | 606/188 |
| 3,608,946 | 9/1971 | Erickson | 294/64.1 |
| 3,641,804 | 2/1972 | Oudenhoven | 72/409.01 |
| 3,901,243 | 8/1975 | Read | 606/188 |
| 3,943,935 | 3/1976 | Cameron | 606/188 |
| 4,164,224 | 8/1979 | Hastings | 606/185 |

FOREIGN PATENT DOCUMENTS

| | | | |
|---|---|---|---|
| 0353963 | 5/1922 | Germany | 604/59 |
| 0342142 | 1/1931 | United Kingdom | 604/59 |

*Primary Examiner*—Michael Powell Buiz
*Assistant Examiner*—Patrick W. Rasche
*Attorney, Agent, or Firm*—Wolf, Greenfield, & Sacks, P.C.

[57] ABSTRACT

A disposable ear-piercing device, ready for immediate use. The disclosure comprises a pair of spaced jaws which receive the earlobe therebetween. One jaw is pre-loaded and carries a piercing pin, while the other jaw is pre-loaded with and carries a locking nut. The jaws are squeezed toward each other in a manner which first causes the earlobe to be gripped and then causes a drive member, carried by the first jaw, to rupture when the jaws are squeezed under a predetermined force, and to transfer the squeezing force directly to the pin, driving it through the earlobe and into engagement with the locking nut. The pin is carried in a cylindrical barrel and is secured against movement in the barrel by frictional engagement of the periphery of the pin head with a portion of the inner surface of the cylindrical barrel. The functional engagement must be sufficient to secure the pin head against inadvertent movement, but not so much that the pin head will bind in the barrel. Compensation for tolerance variation in the barrel which might cause binding is achieved by forming the wall of the cylindrical barrel, intermediate its end, with a flexible, spring-like portion, coincident with the location of the pin head. Response to axial forces on the pin head is facilitated by the flexing of the spring-like portion.

3 Claims, 2 Drawing Sheets

DISPOSABLE EARLOBE PIERCING DEVICE AND THE LIKE

SUBJECT MATTER OF INVENTION

This application relates to a disposable earlobe-piercing device, and in particular, to a means and method of accommodating tolerance variations in the pin-carrying barrel, and to an improved means for releasably securing by friction a cylindrical object in an elongated cylindrical barrel.

BACKGROUND OF THE INVENTION

U.S. Pat. No. 4,164,224 discloses the structure and method of using a disposable earlobe-piercing device. The earlobe piercing device disclosed in that patent has been commercially made and sold since at least as early as 1975, in various embodiments. Although millions of these earlobe-piercing devices have been successfully made and sold, the specific construction illustrated and described has certain inherent limitations, to which this particular invention are specifically directed.

More specifically, the earlobe-piercing device shown in U.S. Pat. No. 4,164,224 secures a pin with a head in a cylindrical barrel by frictional engagement of the periphery of the pin head with a portion of the inner wall or surface of the barrel. The frictional engagement must be sufficiently tight to secure the pin against inadvertent movement until the ear-piercing device is actually put into use. Since these ear-piercing devices are made in large quantities and are shipped to various distribution points throughout the country, they are subject to various forms of movement, which are quite likely to cause the pin to move within the barrel, or even slip from it completely in some instances, if the tolerances of the inner wall of the barrel and pin are outside of an acceptable range. On the other hand, if the frictional interengagement is too great, the pin may bind and thus not properly drive through the earlobe into the locking nut when the piercing device is put into use. Because many millions of these piercing devices are made, these problems, which result from tolerance variation, have been a constant source of manufacturing concern and a source of increased quality-control rejections.

Accordingly, the problem has resulted in increased fabrication costs and occasional malfunctioning units.

SUMMARY OF THE INVENTION

The present invention provides a disposable earlobe-piercing device, of the type and construction generally illustrated in U.S. Pat. No. 4,164,224, with additional features that overcome the problems arising from the tolerance variations described above. In particular, the present invention provides, in a preferred form, an earlobe-piercing device having a pair of jaws adapted to be closed toward one another against inherent tension in the bight, with a pin-carrying barrel secured to one of the jaws. The pin-carrying barrel is defined by a wall that has means for engaging the pin head intermediate the ends of the barrel comprising a frictional engaging portion and a flexible, spring-like portion, with the remaining portions of the wall being relatively rigid and non-yielding, and with this flexible, spring-like portion intermediate the ends of the barrel and coincident with the location of the frictional engaging portion, whereby axial movement of the pin under an axially applied force to the head will be facilitated by flexing of the flexible, spring-like portion. Means for imparting an axial force on the head of the pin are also provided.

In a broader form, the present invention relates generally to a means and method for releasably securing a cylindrical object in an elongated cylindrical barrel, in which the object is positioned intermediate the ends of the barrel and is frictionally engaged with its inner surface. The barrel is defined by a wall that has a flexible, spring-like portion, with the remaining portions of the wall relatively rigid and non-yielding. The flexible, spring-like portion is positioned intermediate the ends of the barrel and coincident with the location of the object, whereby axial movement of the object under an axially applied force will be facilitated by the flexing of the flexible, spring-like portion.

It is an object of the present invention to provide an improved earlobe-piercing device having improved manufacturing characteristics, in which a pin loaded into the ear-piercing device may be secured for selected release with greater certainty than heretofore possible.

A further object of the present invention is to provide an improved ear-piercing device, in which tolerance variations of various components are accommodated in an improved fashion.

A further object of the present invention is to provide an ear piercer of improved design which facilitates the manufacturing process and which materially reduces the likelihood of rejects.

A further object of the present invention is to provide an improved ear-piercing device, which is more certain in use and is less likely to fail.

Another advantage of the present invention provides an arrangement in which there is less likelihood that the piercing pin loaded into a disposable ear piercer will inadvertently fall out.

DESCRIPTION OF DRAWINGS

The foregoing and other objects and advantages of the present invention will be more clearly understood from the following further description thereof, with reference to the accompanying drawings, wherein.

DESCRIPTION OF THE PREFERRED EMBODIMENT

Figure 1:
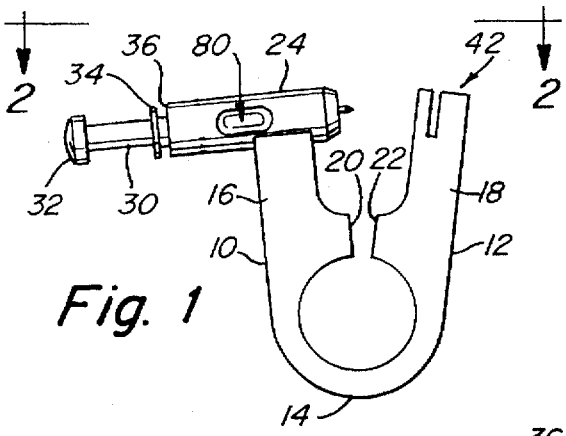
FIG. 1 is a side elevational view of the ear-piercing device.
Figure 2:
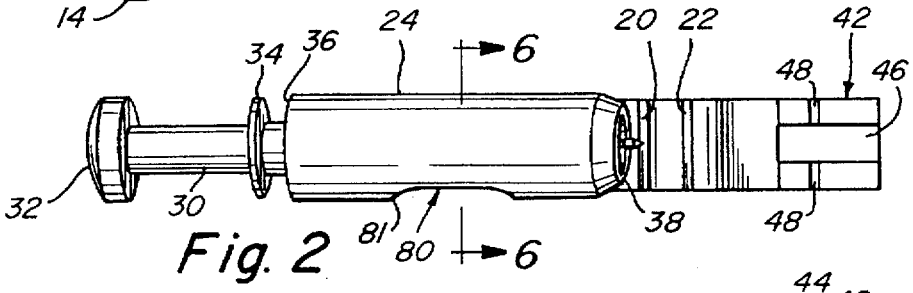
FIG. 2 is an enlarged top view of the device, as seen from the line 2—2 of FIG. 1.
Figure 3:
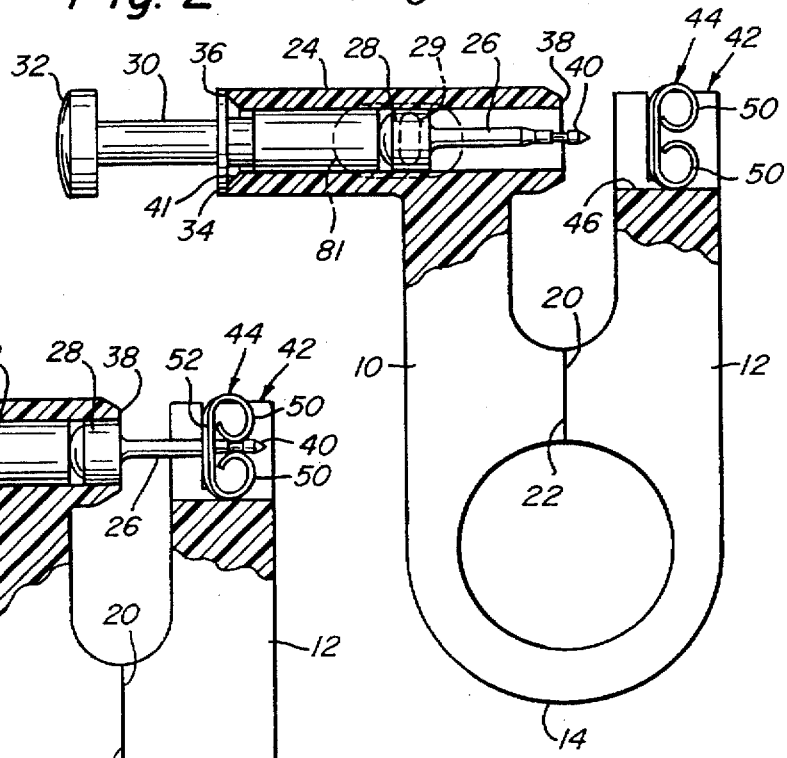
FIG. 3 is an enlarged side elevation of the device, loaded with a pin and nut partially broken away, with the jaws in the most closed position and ready to drive the piercing pin.
Figure 4:
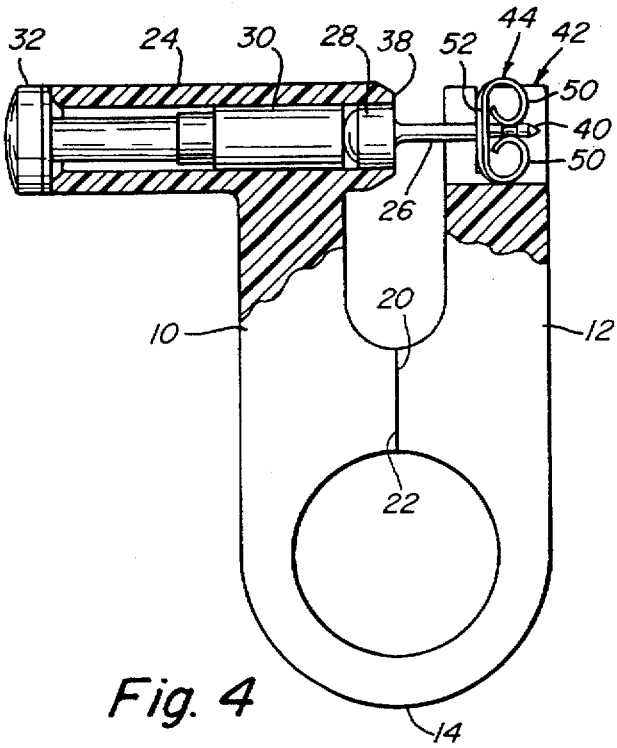
FIG. 4 is an illustration similar to FIG. 3, showing the device after the piercing pin has been driven.

As shown in FIGS. 1 and 2, the illustrative embodiment of the device includes a generally U-shaped member formed of a pair of legs 10, 12 joined at a bight 14, the upper ends of the legs 10, 12 being considered as jaws 16, 18 respectively. The device is fabricated from a single piece of material, preferably a flexible transparent plastic with the bight region 14 of sufficient dimensions to enable the legs 10, 12 and their jaws 16, 18 to be flexed toward each other from the relaxed configuration shown in FIG. 1 to the closed configuration shown in FIG. 3. The bight 14 is sufficiently resilient so that when the squeezed legs are released, they will return to their relaxed configuration. Means are provided for limiting the extent to which the jaws 16, 18 may be closed, such as the inclusion of abutting pads 20, 22 on each of the legs which face inwardly toward each other and preclude jaw closure beyond a predetermined amount as described below.

Secured to the upper end of the jaw 16 is a pin-carrying device which may take the form of a hollow barrel 24 which holds an earlobe piercing pin 26 for sliding movement. The internal dimensions of barrel 24 are such that the pin 26 may be held in place within the barrel, by engagement with the periphery of the head 28 of the pin under a sufficiently light force which can be easily overcome so that the pin can be driven along and through the barrel 24 as described herein. The device should be sized to permit the pin to advance through the barrel freely, except as hereafter discussed. The barrel 24 preferably has a uniformly thick wall that defines a smooth, cylindrical inner surface in which the head 28 may be moved axially under forces applied by the plunger 30 when it is actuated, except for a chordal portion 29 (FIGS. 3 and 6) of about 0.1" in length intermediate the ends of the barrel that narrows the bore of the barrel at the chord by in the order of 0.006". The head of the pin is frictionally engaged and held by this portion or segment 29 against axial forces of up to about one pound.

Figure 6:
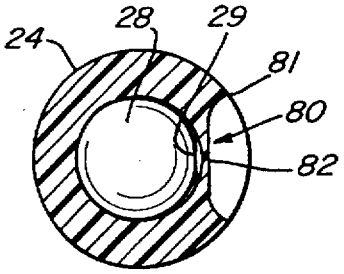
FIG. 6 is a cross sectional view taken on the line 6—6 of FIG. 2.
Figure 7:
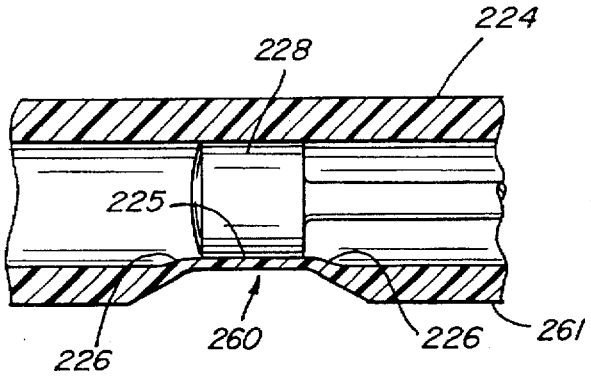
FIG. 7 is an enlarged cross-sectional view along the line 7—7 of FIG. 5.

The normal manufacturing tolerances of this ear piercer are such that the head of the pin 28 may bind in the cylindrical opening at the chordal portion 29 if the tolerances are exceeded, even when under pressure applied to the head of the plunger 30. To minimize the likelihood that such binding will occur, and to accommodate for variations from the desired tolerances, the wall defining the barrel 24 is formed with a flexible, spring-like portion, generally illustrated at 80. This spring-like portion 80 may be integrally formed in the barrel by defining a concave recess in the outer surface of the barrel 24. The concave shape extends from an outer periphery 81 that is elongated and extends longitudinally along said barrel, which has the same thickness as the remaining portions of the barrel wall and tapers, as illustrated in FIGS. 2 and 6, to a relatively thin portion of the wall that may be no more than in the order of 0.004". This extremely narrow portion 82 (FIG. 6) should be positioned directly over the location of the head when the head is in a normal, loaded position, with the pin substantially retracted within the barrel (see dotted outline 81 indicating the location of the periphery 80 in FIG. 3. The flexible, spring-like portion has its inner surface formed as a continuation of the remaining portions of the barrel, except for the chordal portion 29 referred to above. Locating the spring-like portion over the head of the pin facilitates movement of the pin and its head when forces are applied through the plunger 30. Because the concave portion forms a flexible, spring-like element aligned with the chordal portion 29, a binding fit between the head 28 and the inner surface, due to variations that are outside accepted manufacturing tolerances, will not prevent or interfere with the operation of the device. Applying pressure to the head 32 of the plunger 30 will, despite tolerance variables, permit flexing the wall at the spring-like portion.

The pin-carrying and driving mechanism also includes a plunger 30 having a forward end which is received slidably in the rearward end of the bore of the barrel 24. An enlarged knob 32 may be formed at the rearwardly protruding end of the plunger 30. The plunger 30 also is preferably formed from a single piece of plastic material. It includes a thin circumferential collar 34 formed integrally therewith and between the ends of the plunger 30. The collar extends radially outwardly from the plunger so that it will engage the rearward surface 36 of the barrel 24 and preclude further passage of the plunger 30 through the barrel 24 except as described more fully below. The collar 34 is located longitudinally on the plunger 30 in relation to the length of the piercing pin 26 and the location of the forwardmost end 38 of the barrel 24 so that when the collar 34 is in engagement with the rear surface 36 of the barrel and the forwardmost end of the plunger 30 is in contact with the rear end of the head 28 of the pin, the piercing point 40 of the pin will protrude slightly beyond the forward end 38 of the barrel 24 as suggested in FIG. 3. By way of example, the piercing tip of the pin 26 may protrude approximately one-sixteenth of an inch beyond the forward end 38 of the barrel 24. It is desirable to fabricate the plunger 30, collar 34 and rearward end 36 of the barrel 24 so that the rear end of the barrel engages the outermost regions of the collar and provides little or no support for the innermost collar region, where it joins the plunger. This may be achieved by reducing the diameter of the plunger 30 where it joins the collar and/or chamfering the rearward end 36 of the barrel 24 as suggested at 41. This increases the stress applied at the juncture of the collar and plunger.

The other of the jaws 18 is formed to define a chuck, indicated generally by the reference character 42, which is adapted to receive and retain the lock nut 44. One embodiment of the chuck 42 is defined by a longitudinal slot 46 and a transverse, intersecting slot 48 which receive, respectively, the curled fingers 50 and the side flanges 52 of the lock nut 44 as shown. The slots 46, 48 are dimensioned with respect to the portions of the lock nut which they receive so that the lock nut may be held lightly therein so that it will remain in the chuck until it is withdrawn after the piercing operation. The bottom of the longitudinal slot 46 is positioned longitudinally of the leg 12 so that it will position the nut in axial alignment with the pin, thus enabling the piercing point 40 of the pin to be driven through the central hole in the lock nut and be locked thereto by engagement of the end of the pin with the curled fingers 50.

In use, the loaded device is held in a relaxed configuration with its jaws being spread to receive an earlobe. The earlobe, which typically has been marked to highlight the intended piercing location then is aligned with the forwardly protruding piercing point 40 of the pin 26. The device, being gripped between the user's thumb and forefinger with his thumb bearing against the knob 32 of the plunger 30, then is squeezed to grip the earlobe firmly. The legs 10, 12 of the device are drawn together until the pads 20, 22 abut each other which precludes further closure of the jaws. The chuck 42 and forward end 38 of the barrel 24 will then be in their most closed position (FIG. 3), although still being spaced for example, approximately three-sixteenths of an inch. When closed thus far the piercing point 40 depresses the relatively soft ear lobe without piercing the skin.

The material and dimensions of the bight portion 14 preferably are selected in relation to the other dimensions of the device as to require a squeezing force of approximately one pound in order to bring the abutting surfaces 20, 22 together. The collar 34 is sufficiently strong to withstand a one pound closure force without fracturing to enable complete closure of the abutting surfaces 20, 22. The fracture strength of the collar also is such that an increase to a predetermined magnitude in the force which is applied to the collar (of, for example, seven to eight additional pounds) will cause the collar 34 to rupture and separate from the plunger 30 which instantaneously shifts the force from the plunger to the rear end of the pin head 28 which drives the pin instantaneously through the barrel 24, piercing the earlobe and into locking engagement with the locking nut. The grip on the device then may be released to enable it to return to its relaxed configuration under the spring influence of the bight portion 14. The parts of the device are dimensioned so that when released, the forward end 38 of the barrel 24 will be withdrawn rearwardly from the pin head 28. The device then may be removed from the earlobe by simply withdrawing it downwardly from the earlobe to cause the lock nut 44 to be withdrawn from the slots 46, 48.

As described above, the pin 26 is retained in a snug, but slidable, fit within the barrel 24. This may be achieved by a variety of configurations, such as the one discussed above, in which the bore of the barrel is fabricated to close tolerances with respect to the periphery of the pin head in combination with the spring-like portion 80.

Previously, alternate arrangements for securing a snug fit between the pin and the barrel were contemplated. Such alternate arrangements included the inclusion of longitudinal ribs on the interior surface of the barrel to engage the periphery of the pin head. In view of the current invention, such modifications may be unnecessary, with adequate results being achieved utilizing the feature of the present invention.

In the manufacturing process, the U-shaped members are integrally formed in an injection-molding process. In this process, the bores forming the inner walls of the barrels 24 are formed by core pins which move in and out of the mold cavity as the plastic is injected to form the barrel. The core pins are then withdrawn to form the bores. In the withdrawal of the core pins, the barrels are often damaged in designs heretofore used. The provision of the spring-like portion 80 reduces the incident of damage and therefore the rejection rate.

Figure 5:
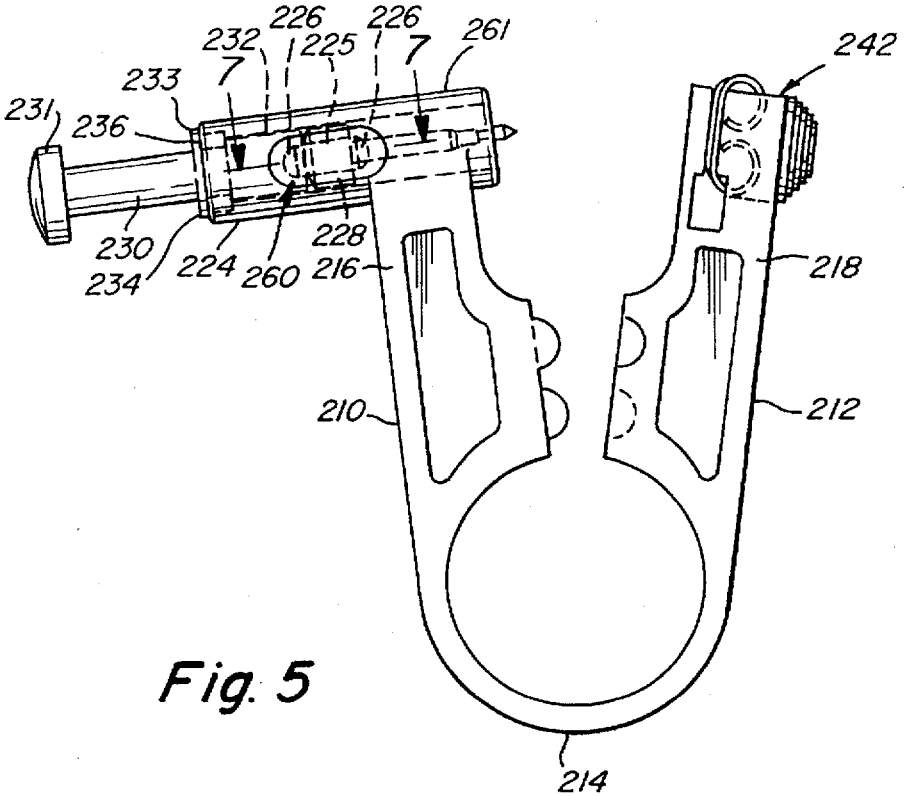
FIG. 5 is an enlarged elevational view, similar to FIG. 1, of the preferred form of the invention, showing in dotted outline the pin and nut in normal prior-to-use state.

The embodiment shown in FIG. 5 is a preferred commercial embodiment and has a number of the structural features that are common or similar in arrangement and function to those described previously. The preferred unit includes legs 210 and 212 interconnected by bight 214. The upper end of the legs 210 and 212 form jaws 216 and 218. The barrel 224 is integrally formed with jaw 216. The barrel is preferably at least partially transparent so that the operator of the device can observe movement of the pin toward the earlobe. A chuck 242 is integrally formed with jaw 218. The U-shaped member may be formed with recessed portions on the faces of the legs to reduce the amount of material incorporated into the ear piercer.

The barrel 224 is formed with a boss 225 on its inner surface, immediately below the spring-like portion 260 (FIG. 5). This boss 225 is preferably an elongated projection with tapered ends 226. The boss 225 is designed to frictionally engage the sidewall of the head 228 of a pin with a friction fit of a force in the order of magnitude of one or two pounds. Because of the spring-like portion 260, the barrel 224 and/or the boss 225 may be resiliently distorted or displaced to allow the pin to pass without binding down the barrel when a force sufficient to overcome the frictional engagement is applied to the end of the pin.

The plunger 230 includes enlarged knob 231 at one end. The other end includes a ram that abuts the head of the pin within the barrel when the plunger is in its normal position. The plunger 230 is maintained in a normal position by the frictional engagement of a projection in the order of magnitude of 0.01", for a ram having a diameter of 0.155" engaging the inner wall of the barrel. This projection is designed to provide sufficient frictional interference to assure that plunger 230 will remain in barrel 224 when loaded, but will not interfere with the frictional movement of the plunger as hereinbefore described. As noted in the earlier described embodiment, barrel 224 is formed with a flexible, spring-like portion 260, the remaining portion of the barrel having a wall that is relatively rigid and non-yielding. Aside from boss 225, the remaining portion 261 of the wall forming the barrel is preferably uniform in thickness and defines an inner smooth cylindrical surface, within which the pin is secured as previously described. The spring-like portion 260 is similar in construction to the spring-like portion 80 described in conjunction with FIG. 1 and includes a portion having a uniformly thick periphery, coinciding with the periphery of the abutting remaining portion of the walls, tapering to a thickness in the order of 0.002" to 0.004". The spring-like portion 260 overlies the position of the pin head 228 when in a normal position prior to use. Flanges or collars 233 and 234 with the end 236 of barrel 224 will locate the extreme end of ram 232 adjacent the head of the pin secured by boss 225. The collars 233 are integral with the plunger and are dimensioned to that approximately 5 to 10 pounds, and preferably 9 pounds, of force exerted against the collars will cause them to shear off when the plunger is pushed into the barrel. It has been determined that greater control or uniformity may be attained by making collars as described.

The chuck 242 is designed to hold a nut lightly in position against inadvertent dislocation during handling and prior to shipment in a manner described in U.S. Pat. No. 4,164,224.

What is claimed is:

1. A means for releasable securing a cylindrical object in an elongated cylindrical barrel having a wall with ends and an outer surface and an inner surface with said object positioned within and frictionally engaged by the inner surface of said barrel intermediate its ends, wherein said barrel is defined by a wall having a flexible spring-like portion with relatively rigid and non-yielding remaining portions of the wall, said flexible spring-like portion integrally formed with and of the same material as said remaining portions of said barrel and comprising a concave section formed in the outer surface of said barrel, with the thickness of said barrel within said concave section being less than the thickness of the other portions of said barrel, said flexible spring-like portion positioned intermediate the ends of the barrel and coincident with the location of said object wherein axial movement of said object under an axially applied force will be facilitated by flexing of said flexible spring-like portion, and means for imparting an axial force on said object.

2. A means for releasing a cylindrical object as set forth in claim 1 wherein said cylindrical object comprises the head of an ear-piercing pin.

3. A means as set forth in claim 2 wherein said means for releasably securing a cylindrical object comprises an earlobe-piercing device and wherein said head of ear-piercing pin is engaged by said flexible spring-like portion.

* * * * *